US007607516B2

(12) United States Patent
Simon et al.

(10) Patent No.: US 7,607,516 B2
(45) Date of Patent: Oct. 27, 2009

(54) ELEVATOR GOVERNOR DEVICE

(75) Inventors: Andres Monzon Simon, Madrid (ES); Fernando Del Rio Sanz, Madrid (ES)

(73) Assignee: Otis Elevator Company, Farmington, CT (US)

( * ) Notice: Subject to any disclaimer, the term of this patent is extended or adjusted under 35 U.S.C. 154(b) by 556 days.

(21) Appl. No.: 10/578,058

(22) PCT Filed: Nov. 18, 2003

(86) PCT No.: PCT/US03/37242

§ 371 (c)(1),
(2), (4) Date: May 2, 2006

(87) PCT Pub. No.: WO2005/061362

PCT Pub. Date: Jul. 7, 2005

(65) Prior Publication Data

US 2007/0056805 A1 Mar. 15, 2007

(51) Int. Cl.
*B66B 5/06* (2006.01)

(52) U.S. Cl. ..... 187/286; 187/285; 187/287; 187/350; 187/351

(58) Field of Classification Search ..... 187/286, 187/287, 350, 351, 285
See application file for complete search history.

(56) References Cited

U.S. PATENT DOCUMENTS 5,052,523 A * 10/1991 Ericson ..... 187/350
5,217,091 A 6/1993 Shiina et al.
5,377,786 A 1/1995 Nakagawa
5,492,200 A 2/1996 Korhonen
5,653,312 A 8/1997 Kato
5,817,994 A * 10/1998 Fried et al. ..... 187/391
6,186,281 B1 * 2/2001 Pietrzykowski et al. ..... 187/287
6,311,801 B1 * 11/2001 Takagi et al. ..... 187/290
6,360,847 B1 * 3/2002 Okada et al. ..... 187/373
6,405,834 B1 * 6/2002 Chida et al. ..... 187/391
6,457,569 B2 * 10/2002 Draper et al. ..... 188/180

(Continued)

FOREIGN PATENT DOCUMENTS

CA 2081136 4/1993

(Continued)

OTHER PUBLICATIONS

International Search Report dated May 10, 2004 relating to International Application No. PCT/US03/37242.

(Continued)

*Primary Examiner*—Bentsu Ro
*Assistant Examiner*—Kawing Chan
(74) *Attorney, Agent, or Firm*—Carlson, Gaskey & Olds PC

(57) ABSTRACT

An elevator governor includes a selectively powered switch (60) that is activated when an elevator car moves at a speed that exceeds a selected limit. The speed limit is lower than normally expected car speeds during normal elevator operation. The switch (60) is activated by a moving member (66) that moves into a switch-activation position responsive to movement of a rotating member (36) that corresponds to movement of an elevator car. The arrangement allows for a primary governor to prevent elevator speeds from exceeding a first selected limit and a secondary governor to prevent elevator speeds from exceeding a second, lower limit.

17 Claims, 4 Drawing Sheets

U.S. PATENT DOCUMENTS

| | | | | |
|---|---|---|---|---|
| 6,988,593 | B2 * | 1/2006 | Sanchez et al. | 187/376 |
| 2004/0079591 | A1 * | 4/2004 | Mueller | 187/287 |
| 2004/0173413 | A1 * | 9/2004 | Angst et al. | 187/287 |

FOREIGN PATENT DOCUMENTS

| | | | |
|---|---|---|---|
| JP | 2003104646 | 4/2003 | |
| WO | WO03004397 | * | 1/2003 |

OTHER PUBLICATIONS

Written Opinion mailed Nov. 26, 2004 relating to International Application No. PCT/US03/37242.
International Preliminary Examination Report mailed Jul. 20, 2005 relating to International Application No. PCT/US03/37242.

* cited by examiner

ELEVATOR GOVERNOR DEVICE

FIELD OF THE INVENTION

This invention generally relates to elevator governors. More particularly, this invention relates to an elevator governor device that is selectively useable under certain conditions such as during maintenance.

DESCRIPTION OF THE RELATED ART

Elevator systems typically include a governor device that prevents the elevator car from moving at an undesirably high speed through a hoistway. Conventional arrangements include a governor sheave and a tension sheave. A governor rope travels around a loop with the two sheaves at opposite ends. The governor rope moves with the elevator car through the hoistway. The governor device includes flyweights or flyballs that move when the governor sheave rotates at a speed indicating that the elevator car is moving too fast. The movement of the flyweights or flyballs causes a device that causes the governor rope to activate linkage arrangement that engages a safety device for bringing the elevator car to a stop.

There are a variety of known governor devices. Each of them has certain advantages or drawbacks. None of them, however, addresses all needs for elevator car speed control. For example, elevator car speed during normal operation must be kept below a selected limit and the typical governor is set to prevent movement beyond that speed. Such governors are not readily useable at a variety of speed limits. There are other situations, such as maintenance procedures, during which the elevator car speed must be kept below a lower limit. Recent safety codes, for example, require that for elevators with low overhead there is a system to limit the speed of the car during inspection or maintenance to 0.7 meters per second. A typical governor device will not interfere with car movement at speeds that far exceed this low limit.

Accordingly, there is a need for improvements to elevator governor systems that will accommodate differing speed control limits for different conditions or situations. This invention addresses that need.

SUMMARY OF THE INVENTION

In general terms, this invention is a governor device useful with an elevator system that includes a selectively powered switch that activates the governor device to control a speed of movement of an elevator car.

One example device designed according to this invention includes a rotating member that rotates responsive to movement of an elevator car. A selectively powered switch is located near the rotating member. A moving member is biased into a position to not interact with the selectively powered switch. The moving member moves into a position to activate the switch responsive to a selected speed of rotation of the rotating member. Once the switch is activated, the governor device is operative to slow down or stop movement of the elevator car.

In one example, the moving member is supported for movement relative to a primary governor sheave. In another example, the moving member is supported for movement relative to a tension sheave of a primary governor.

In one example, the selectively powered switch is activated by a mechanic or technician whenever elevator maintenance or inspection is required. The inventive governor device allows for selectively keeping the elevator car speed below a chosen limit for such situations. The choice of whether to power the selectively powered switch allows for leaving the inventive governor device in place during normal elevator system operation without interfering with the higher car speeds required for normal elevator operation.

In one example, the selectively powered switch includes a coil that is selectively powered to make the switch effective for providing an indication of an over speed condition. In one example, a remote signaling device is useful for selectively powering the coil of the switch. In another example, the coil is rearmed responsive to the elevator being placed into inspection or maintenance mode.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
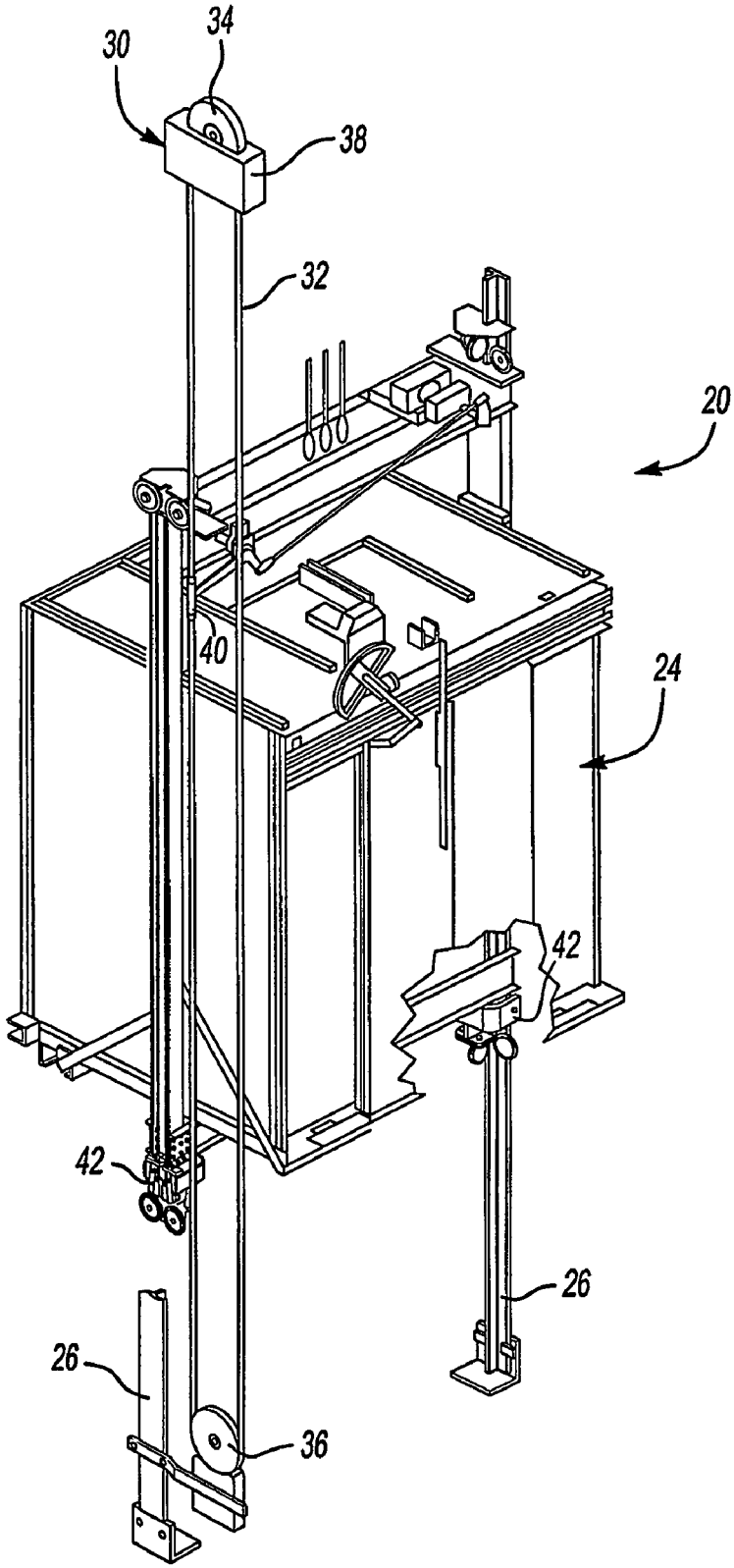
FIG. 1 schematically illustrates selected components of an elevator system including a governor device designed according to this invention.

FIG. 1 shows an elevator system 20 including an elevator car assembly 24 that moves along guide rails 26 in a conventional manner. A governor device 30 controls movement of the elevator car 24 by preventing the car from moving beyond a selected maximum speed. The example governor device 30 includes a governor rope 32 that travels with the car 24 as the car moves along the guide rails 26. A governor sheave 34 and a tension sheave 36 are at opposite ends of a loop followed by the governor rope 32.

The illustrated governor device 30 includes a primary governor portion that operates in a known manner to prevent an over speed condition during normal elevator operation. A conventional governor activating mechanism (not shown) is supported by the housing 38, which includes flyweights, for example, that move when the governor sheave 34 rotates beyond a selected speed as caused by movement of the car 24. The primary governor locking mechanism includes jaws as known in the art (not shown) that clamp onto the governor rope 32 under such conditions. Further movement of the car 24 then causes the rope 32 to pull upon a mechanical linkage 40, which activates safety devices 42, which in this example apply a braking force against the guide rails 26 to prevent further movement of the car 24.

The primary governor function of the governor device 30 is provided by conventional components that operate in a known manner.

The governor device 30 in this example includes an additional feature to control elevator car speed under selected conditions. The example governor device includes a selectively powered switch that allows the governor device 30 to prevent the elevator car 24 from moving faster than a selected speed limit that is lower than the normal expected or required car speed during normal elevator system operation. In one example, the governor device includes a switch that is selectively powered to provide a governor function during inspection or maintenance of the elevator system.

Figure 2:
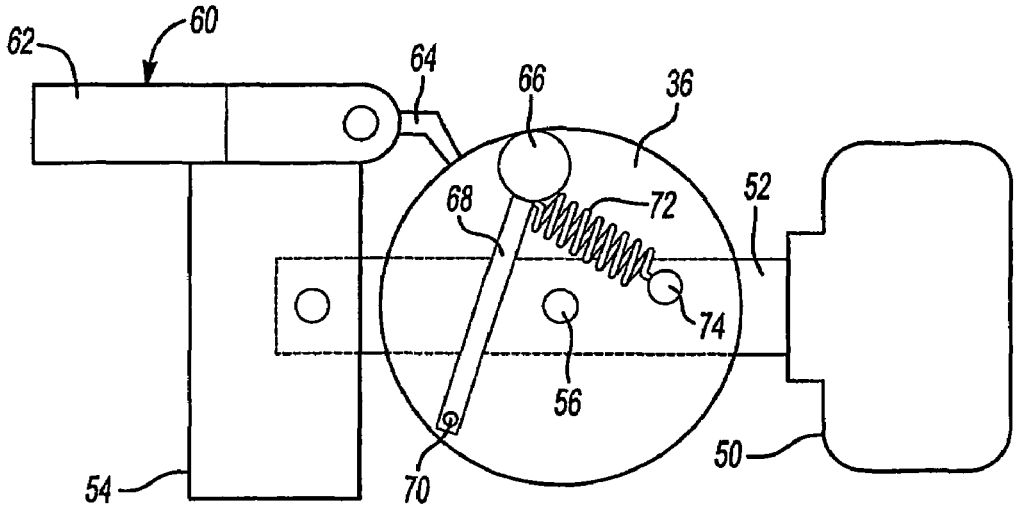
FIG. 2 schematically illustrates one example embodiment of a governor device designed according to this invention.

FIG. 2 schematically illustrates selected components of the example governor device 30. The tension sheave 36 in this example is associated with a tension weight 50 that is supported on an arm 52, which is rotationally supported by a bracket 54. The tension sheave 36 rotates about an axle 56 supported on the arm 52 and rotates responsive to movement of the governor rope 32.

A switch 60 is selectively powered to selectively make the governor device 30 operable to prevent car speeds that exceed a selected limit that is lower than normal elevator car operation speed. The switch 60 includes a power module 62 that allows the switch 60 to be activated when power is supplied to the power module 62. In one example, the power module 62 comprises a rearming coil that is electrically powered to set the switch 60 into an operative condition. A switch arm 64 is positioned near the tension sheave 36 so that a flyweight 66 contacts the arm 64 to activate the switch 60 when the car speed exceeds a selected limit. In this example, the flyweight 66 is supported on a lever 68 that pivots about an axis 70 supported on the tension sheave 36.

A spring 72 biases the flyweight 66 into a position where it will not contact the switch arm 64 unless the tension sheave 36 rotates beyond a selected speed limit. The spring 72 has one end secured to the lever 68 and a second end 74 secured to the tension sheave 36 in this example. Those skilled in the art who have the benefit of this description will be able to select appropriate components so that the governor device will activate the switch 60 responsive to the car moving beyond a selected limit.

During normal elevator system operation, the switch 60 preferably is not powered. Accordingly, the flyweight 66 will move into a position to contact the switch arm 64 as the elevator car moves between landings at a speed required to provide a desired service to a passenger, for example. Because the switch 60 is not powered, the governor device 30 does not prevent movement of the elevator car 24 at such speeds. During a maintenance or inspection procedure, however, the switch 60 preferably is powered so that movement of the elevator car 24 beyond a speed that is lower than normal operation speed will trigger or activate the switch 60 to prevent movement of the elevator car 24 beyond the lower, inspection speed.

In one example, the switch 60 activates a conventional safety device to bring the elevator car to a complete stop whenever the inspection speed is exceeded and the switch 60 is powered. In another example, activation of the switch 60 causes a sheave brake to operate to slow down rotation of a traction sheave, for example, to slow down movement of the elevator car 24 as needed. Given this description, those skilled in the art will realize that a variety of safety or braking devices may be used in combination with a governor device designed according to this invention to achieve a desired response to an inspection over speed condition.

Figure 3:
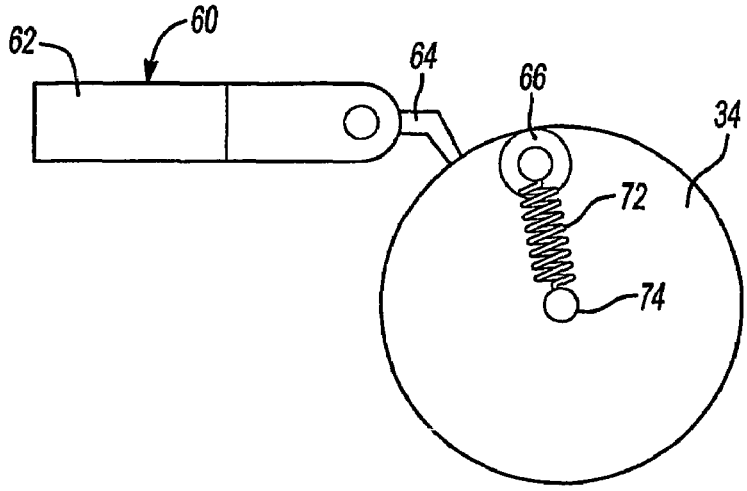
FIG. 3 schematically illustrates another example embodiment of a governor device designed according to this invention.

FIG. 3 schematically illustrates another example embodiment. In this example, the flyweight 66 is supported for movement relative to the governor sheave 34. The spring 72 in this example is associated directly with the flyweight 66 and no lever 68 is provided. The switch 60 is supported on the housing 38 in a position so that the switch arm 64 is contacted by the flyweight 66 whenever the elevator car speed 24 exceeds a desired limit. The switch 60 preferably is not powered during normal elevator operation because the flyweight 66 will contact the switch arm 64 as the governor sheave 34 rotates at speeds corresponding to normal, expected elevator car speeds during normal system operation.

Figure 4:
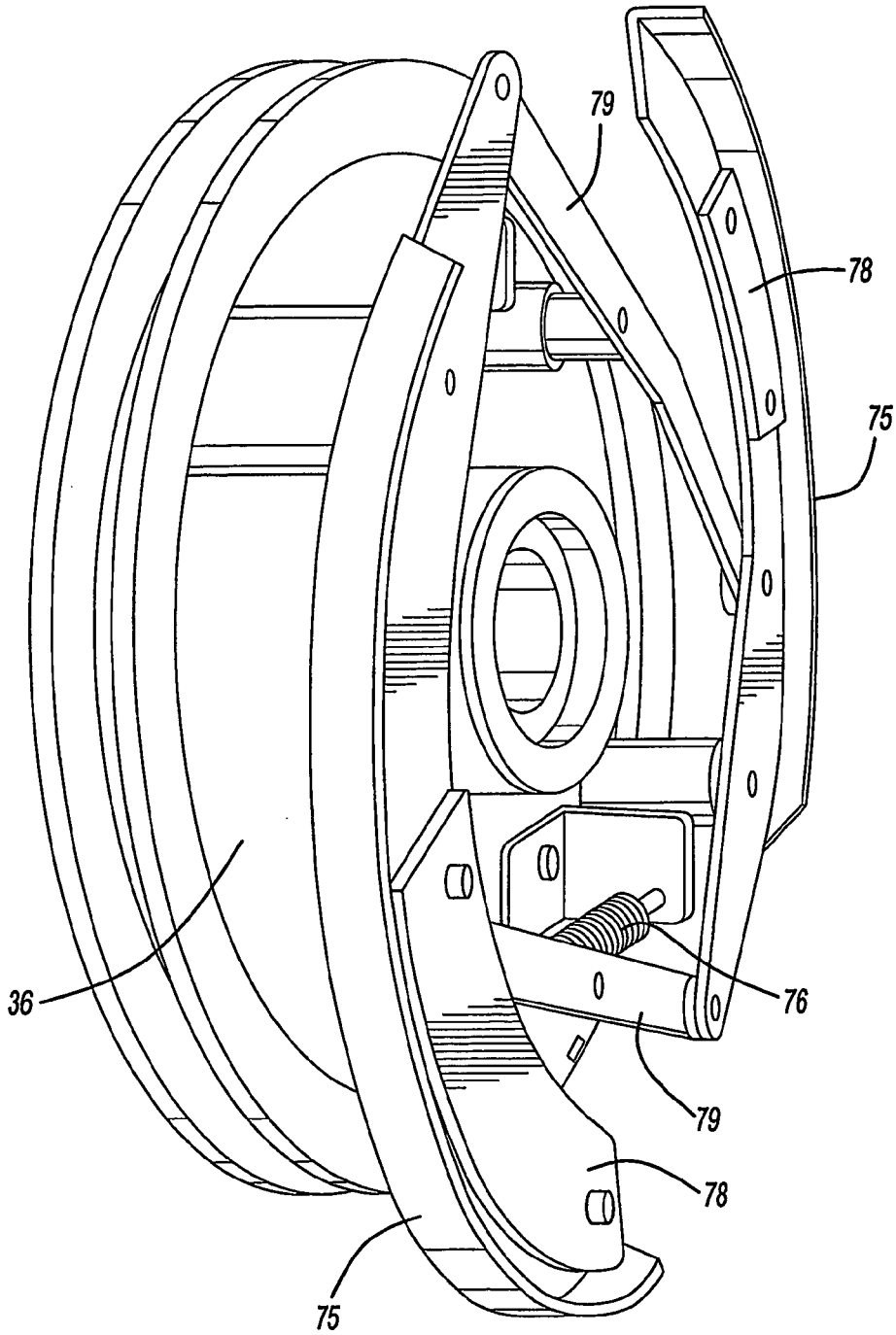
FIG. 4 illustrates another example embodiment.

FIG. 4 schematically shows another example where the switch 64 is contacted by arms 75 that move radially outward responsive to adequate rotational speeds of the sheave 36. The arms 75 are biased inward by a spring 76 and include weights 78, which are selected to provide-appropriate outward movement of the arms 75. A linkage 79 causes the arms 75 to move simultaneously.

Figure 5:
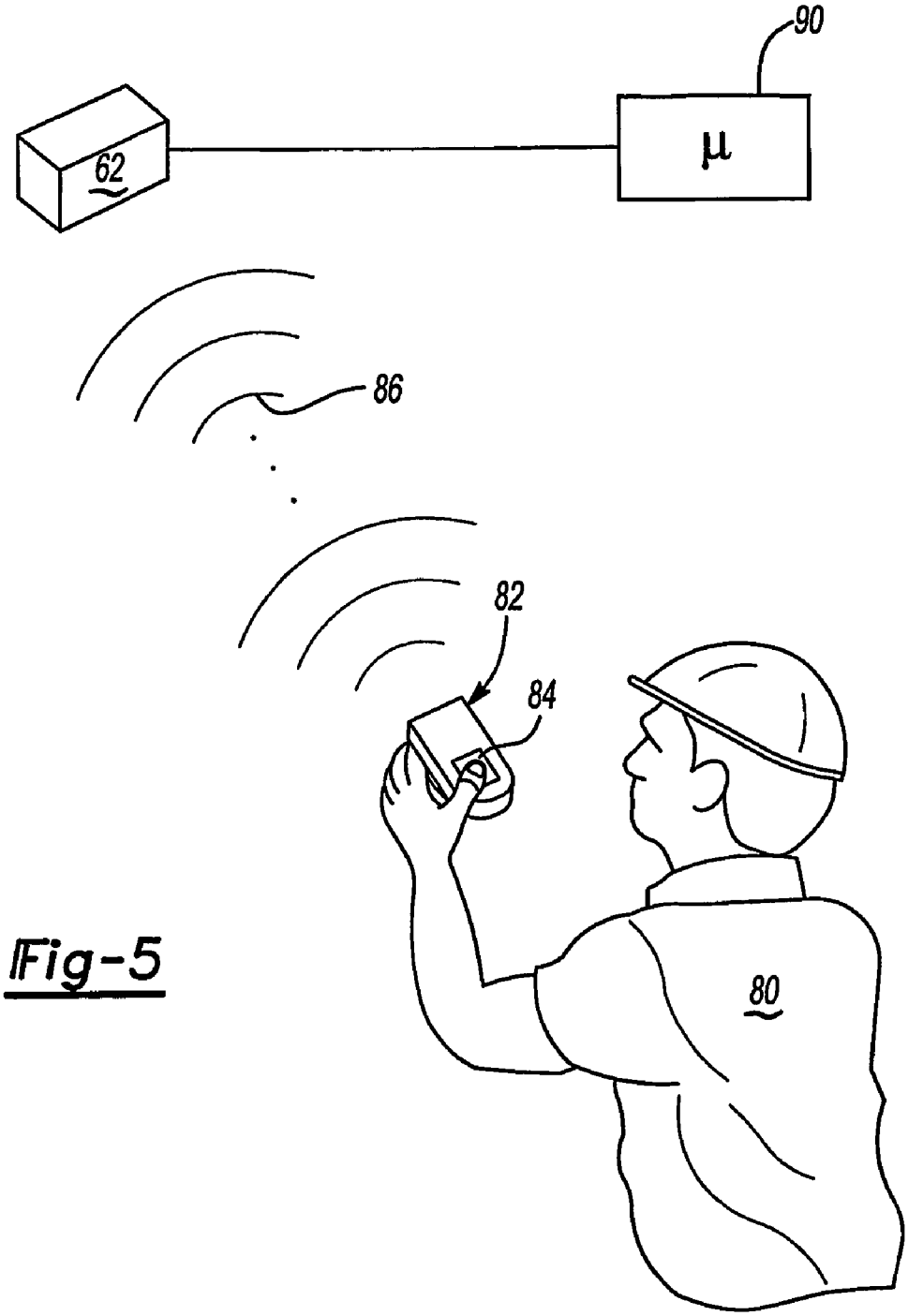
FIG. 5 schematically illustrates example techniques for selectively powering a switch in a governor device designed according to this invention.

FIG. 5 shows two possible ways for the power module 62 to be actuated. A mechanic or technician 80 uses a communication device 82 for selectively powering the power module 62 of the switch 60 to allow the governor device 30 to provide the over speed protection at the lower limit. In this example, the communication device 82 includes at least one switch 84 that is selectively actuated by the individual 80 to generate a wireless communication signal 86 that indicates a desire to turn on or turn off the power module 62. The switch 60 responds to such a signal by turning the switch on or off depending on the needs of the particular situation. A variety of configurations for the communication device 82 are possible and within the scope of this invention.

In another example, the individual 80 uses a switch on a control panel within the elevator car 24, a system controller, a controller mounted on top of the car 24 or an ERO box to select whether the switch 60 is powered or not. FIG. 5 schematically shows a controller 90 to represent all of these. In one example, the system controller 90 automatically activates the power module 62 each time that the system is placed into an inspection mode. In another example, the power module 62 automatically powers the switch 60 when a hoistway door is opened. Those skilled in the art who have the benefit of this description will be able to select the best option or combination to provide the capability to remotely set the switch 60 to accommodate an inspection mode.

This invention provides an elevator governor device that allows for selectively controlling the speed of elevator car movement at a limit that is within the acceptable operating speeds of the car-during normal system operation. The inventive governor device can be incorporated into and be a part of a primary governor device as illustrated and described above. In another example, the inventive governor device is a standalone device that operates independent of the components of the primary governor arrangement.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A governor device for use in an elevator system, comprising:

a rotating member that rotates responsive to movement of an elevator car;

a selectively powered switch near the rotating member; and a moving member that is biased into a position to not activate the switch, the moving member moving into a position to activate the switch responsive to the rotating member rotating at a speed beyond a selected limit that corresponds to movement of the elevator car at a speed below a desired speed during normal elevator system operation, the switch only being powered to operate under selected conditions other than normal elevator system operation.

2. The device of claim 1, wherein the switch includes a power module that is selectively powered to allow the switch to be activated responsive to contact between the moving member and the switch.

3. The device of claim 2, wherein the power module comprises a rearming coil.

4. The device of claim 1, including a brake that acts upon a component associated with the elevator car to limit movement of the car responsive to the switch being activated by the moving member.

5. The device of claim 1, including a biasing member that urges the moving member radially inward relative to the rotating member.

6. The device of claim 5, wherein the biasing member comprises a spring.

7. The device of claim 5, including a lever having one end pivotally supported on the rotating member and a second end associated with the moving member and wherein the biasing member urges the lever away from an outer edge of the rotating member.

8. The device of claim 5, wherein the moving member comprises a plurality of arms linked together to move outward simultaneously.

9. The device of claim 1, wherein the rotating member is a governor sheave.

10. The device of claim 1, wherein the rotating member is a tension pulley.

11. The device of claim 1, including a control that selectively powers the switch.

12. The device of claim 11, wherein the control generates a wireless communication signal that indicates a desired operation condition of the switch.

13. The device of claim 12, wherein the control comprises a hand-held signaling device.

14. The device of claim 11, wherein the control automatically powers the switch when the elevator system is in a inspection mode.

15. The device of claim 1, including a primary governor that prevents movement of the car independent of the switch when the car speed exceeds a first limit and wherein the moving member moves into a position to activate the switch when the car speed exceeds a second, lower limit.

16. The device of claim 1, wherein the switch is powered during at least one of an inspection procedure, a maintenance procedure or a period during which a hoistway door is open.

17. The device of claim 1, wherein the moving member contacts the switch during normal elevator system operation when the switch is not powered.

* * * * *

UNITED STATES PATENT AND TRADEMARK OFFICE

CERTIFICATE OF CORRECTION

PATENT NO. : 7,607,516 B2
APPLICATION NO. : 10/578058
DATED : October 27, 2009
INVENTOR(S) : Simon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 734 days.

Signed and Sealed this

Twelfth Day of October, 2010

David J. Kappos

David J. Kappos
*Director of the United States Patent and Trademark Office*